US006233878B1

(12) United States Patent
Krähenbühl et al.

(10) Patent No.: US 6,233,878 B1
(45) Date of Patent: May 22, 2001

(54) SLIDING WALL

(75) Inventors: Hans Krähenbühl, Niederscherli; Jürg Nyffenegger; Heinz Ulrich, both of Schwarzenburg, all of (CH)

(73) Assignee: Kaba Gilgen AG, Schwarzenburg (CH)

( * ) Notice: Subject to any disclaimer, the term of this patent is extended or adjusted under 35 U.S.C. 154(b) by 0 days.

(21) Appl. No.: 09/299,146

(22) Filed: Apr. 26, 1999

(30) Foreign Application Priority Data

Apr. 27, 1998 (EP) ..... 98810365

(51) Int. Cl.[7] ..... E05F 15/14
(52) U.S. Cl. ..... 52/64; 49/409
(58) Field of Search ..... 52/64, 243.1, 238.1; 49/409–412, 221, 217, 457; 160/196.1

(56) References Cited

U.S. PATENT DOCUMENTS

| | | | | |
|---|---|---|---|---|
| 4,991,257 | * | 2/1991 | Eutebach | 16/87 R |
| 5,471,791 | * | 12/1995 | Keller | 49/317 |
| 5,544,462 | | 8/1996 | Kordes . | |
| 5,577,348 | * | 11/1996 | Keller | 49/317 |
| 6,018,915 | * | 2/2000 | Pomish et al. | 52/64 |
| 6,082,053 | * | 7/2000 | Bischof et al. | 52/64 |
| 6,098,342 | * | 8/2000 | Bischof et al. | 49/409 |

FOREIGN PATENT DOCUMENTS

| | | |
|---|---|---|
| 24 04 875 A1 | 8/1975 | (DE) . |
| 36 26 321A1 | 2/1988 | (DE) . |
| 195 41 758 | 5/1997 | (DE) . |
| 0 597 208 | 5/1994 | (EP) . |
| WO 97/42388 | 11/1997 | (WO) . |
| 99/57402 | 11/1999 | (WO) . |

OTHER PUBLICATIONS

English translation of claim from WO 99/57402.
D. Kappelhoff et al, "Mobile room Partition Panel", Derwent abstract for DE 31 47 273, (1983).
F. Kummer et al., "Motor–Driven Sliding Door", Derwent abstract for DE 29 10 185, (1980).
G. Dumbser, "Motor Driven Sliding Wall Panel", Derwent abstract for DE 26 43 905, (1978).

* cited by examiner

*Primary Examiner*—Christopher T. Kent
*Assistant Examiner*—Jennifer I. Thissell
(74) *Attorney, Agent, or Firm*—Finnegan, Henderson, Farabow, Garrett & Dunner, L.L.P.

(57) ABSTRACT

In a sliding wall (10) comprising a plural number of individually slidable wall elements (13), with each of the wall elements (13) at its upper edge near the ceiling being delimited by a horizontally aligned support profile (12), and being laterally slidable along a common track (11) arranged above the support profile (12) by means of at least one running gear (14, 30) attached to the support profile; with each wall element (13) comprising its own drive (17) with an electrically operated drive motor (27), said drive (17) being attached to the wall element (13) and interacting with the track (11) by way of drive means (24, 25), a compact construction and at the same time flexible application are achieved in that the drive motor (27) is arranged within the support profile (12).

26 Claims, 5 Drawing Sheets

SLIDING WALL

TECHNICAL FIELD

The present invention relates to the field of sliding walls. It concerns a sliding wall with a plural number of individually slidable wall elements, with each of the wall elements at its upper edge near the ceiling being delimited by a horizontally aligned support profile, and being laterally slidable along a common track arranged above the support profile by means of at least one running gear attached to the support profile, with each wall element comprising its own drive with an electrically operated drive motor, said drive being attached to the wall element and interacting with the track by way of drive means.

Such a sliding wall is for example known from printed publication DE-C3-24 04 875 or printed publication WO 97/42388.

STATE OF THE ART

Increasingly, in large spaces for variable use, for example in shopping malls and similar, sliding walls are used for flexible partial or complete separation of areas. The wall elements of such sliding walls are suspended from the ceiling so as to be easily slidable; they can be united along a track to form a closed wall or they can be pushed together into a parking position on the wall side of the space, to form an upright stack taking up little room. Moving of the individual wall elements can take place manually, but automatic solutions are also imaginable where the individual wall elements are driven by an integrated electric motor and controlled by a central control unit.

The wall elements themselves can be configured as glass elements without lateral frame components so as to form a continuous glass wall, said wall elements being delimited on the top by a support profile for suspension in the track, and optionally on the bottom may comprise a floor profile for guidance or locking purposes. However, the wall elements can also be non-transparent, for example made of wood, metal or other wall construction materials.

Sliding walls of the type described have to meet increasingly stringent requirements both concerning aesthetic appearance and practical considerations such as space-saving installation or flexible (modular) expandability or simple changeover from manual to automatic operation. Known solutions can no longer adequately meet these requirements or cannot meet them at all. From the printed publication DE-C3-24 04 875 mentioned in the introduction, a sliding wall made of movable wall elements is known, with each of said elements being slidably suspended by means of two track carriages, from a rail attached to the underside of the ceiling. Each individual wall element is driven by an electric motor integrated in the wall element; said electric motor driving a pinion provided in one of the track carriages; said pinion interacting with a chain, track or similar attached to the side wall inside the track. On the other track carriage, the current required for the electric motor is taken up by current collectors, from a conductor rail arranged within the track. The electric motor is positioned vertically, below the upper cross piece in the double-walled area of the wall element. Thus the known solution is not suitable for wall elements which are configured as transparent glass elements. The same also applies to the motor-driven room-divider wall element disclosed in DE-C2-26 43 905 as well as the room divider described in DE-C2-31 47 273.

Furthermore, from DE-C2-29 10 185 a door or similar with a motor-driven slidable leaf is known where the leaf is attached to a track carriage guided by means of rollers in a support profile. The electric motor provided for the drive which interacts with a pinion in a rack profile in the support profile is accommodated above the track carriage in the interior of the carrier profile. While this arrangement allows a free selection of the type and shape of the leaf, the accommodation of the drive in the track carrier profile however, requires a very wide large-volume track which takes up a lot of space and which can only be integrated with difficulty into a ceiling. Accommodating the drive inside the track further necessitates the provision of a removable cover for maintenance and repair purposes which in turn leads to additional complexity in the construction of the track. Furthermore, the disclosed solution is not practical for a sliding wall with a plural number of individual elements if for no other reason because electricity supply to the electric motor is via a longitudinally extending spiral cable accommodated within the track.

In the case of another known movable sliding wall comprising several panel shaped wall elements (EP-B1-0 597 208) the wall elements are also motor driven via a drive unit which is accommodated in the ceiling rail, together with the track carriage. Here too, an especially wide and high ceiling rail or track must be used which takes up a lot of room and makes installation and maintenance more difficult.

The printed publication WO 97/42388 mentioned in the introduction describes a sliding wall where the individual wall elements are driven by a horizontally-positioned electric motor accommodated on the track carriage and which together with the associated current collectors protrudes from the track carriage laterally, i.e. across the direction of travel. This known solution is characterised by an even wider design in the track area. In addition it has the following disadvantage: Quite frequently the user of a sliding wall first has a manually moveable wall installed without motor drive, but later wants to automate the installed wall by adding an electric motor-drive with control unit. In this case subsequent automation not only requires considerable expenditure but also leads to extensive downtime of the sliding wall. If on the other hand a track suitable for later automation is installed right from the start, there are unjustifiably high and unnecessary initial costs for a simple manually operated wall and unnecessarily large space requirements.

PRESENTATION OF THE INVENTION

It is thus the object of the invention to create a sliding wall which can be flexibly adapted to a very large variety of applications and uses; which requires little space concerning the rail attached to the ceiling; which is designed both for manual and automatic operation without any change in the rail structure; and which meets even more stringent requirements for aesthetic appearance.

In a sliding wall of the type mentioned in the introduction, this object is met in that the drive motor is arranged within the support profile. The arrangement of the drive motor in the support profile, according to the invention makes it possible to have an extremely slim-line design of the track attached to the ceiling because practically no additional space for the drive needs to be provided in the rail. As is also the case with manually slidable wall elements, the rail only needs to be designed for accommodating and guiding the running gear. The conductor rail and the drive means accommodated in the track, such as for example a rack, toothed belt or similar, which are needed for an electrical drive, can be integrated in the track in a space-saving way. Consequently the same slim track can be used both for manual and for automatic operation. This makes any future change from manual operation to automatic operation extremely easy, later on only requiring insertion of a conductor rail and for example a toothed belt—if they are not already present. In addition, the existing running gear merely needs to be replaced with running gears containing an electric motor drive and current collectors. In addition, the arrangement of the drive motor in the support profile has the advantage that a transparent glass panel or any other materials and element structures attached to the support profile can be used without any restrictions, because the space requirement for the drive only applies to the support profile.

From the point of view of the space required it is particularly favourable if according to a first preferred embodiment of the sliding wall according to the invention, the drive axis of the drive motor is aligned parallel to the longitudinal axis of the support profile. In this way an elongated powerful motor can be accommodated in the support profile, invisibly from the outside, without the cross section of the support profile having to be significantly enlarged or enlarged at all.

A preferred improvement of this embodiment is characterised in that the drive means comprise a pinion driven by the drive motor which interacts with a toothed profile extending longitudinally within the support profile; that the toothed profile is a toothed belt inserted into the support profile; that the pinion is rotatable around a vertical axis and interacts with the vertically arranged toothed belt; and that the power transmission from the drive motor to the pinion is by way of an angular gear arrangement. The vertical arrangement of the pinion axis and the toothed belt makes it possible to keep the drive train compact. The vertically positioned toothed belt is particularly advantageous if the track in the ceiling plane is curved, because the toothed belt configured in such a way can easily and without any additional measures follow the curves, due to its bending characteristics as a toothed belt, even if the radius of curvature is tight.

A further preferred embodiment of the invention is characterised in that to provide electricity to the drive motor within the track, a conductor rail extending in longitudinal direction of the rail is arranged within the rail; and in that each wall element comprises a running gear which by means of current collectors attached to the running gear, take up power from the conductor rail and conduct it to the drive motor. Integration of the conductor rail into the track not only automatically protects the conductor rail from dirt and unintended contact, but it also makes it possible to keep the track very compact.

Particularly efficient use of space is achieved if each wall element comprises two running gears arranged one behind the other in the direction of travel, and if the wall element is driven via the first running gear and current collection takes place via the second running gear.

In a simple way, the track can equally and without reconstruction be used for manual or automatic operation if according to a further preferred embodiment the track is configured as a profile rail axially symmetrical to a centre axis, which in the interior comprises a running surface on which the running gears run on carrying rollers; if below the running surface there are two lateral grooves which are facing each other and which are aligned in longitudinal direction of the rail, said lateral grooves being open toward the inside; and if the conductor rail is arranged in one lateral groove and the toothed belt is arranged in the other lateral groove.

Operation of the sliding wall with the most simple construction of the electricity supply system and control system can be designed to be very flexible if according to another preferred embodiment of the sliding wall according to the invention, a local control unit is provided in each of the wall elements which control unit controls the drive motor of the associated wall element; if the local control units exchange information via a data bus with a central control unit; if the conductor rail is used as the data bus; and if in each wall element, means are provided which gather information about the movements of the wall element and transmit such information to the local control unit of the wall element for further processing.

Further embodiments are provided in the dependent claims.

BRIEF EXPLANATION OF THE FIGURES

Below, the invention is illustrated by means of the drawing, depicting the following.

WAYS OF REALISING THE INVENTION

Figure 1:
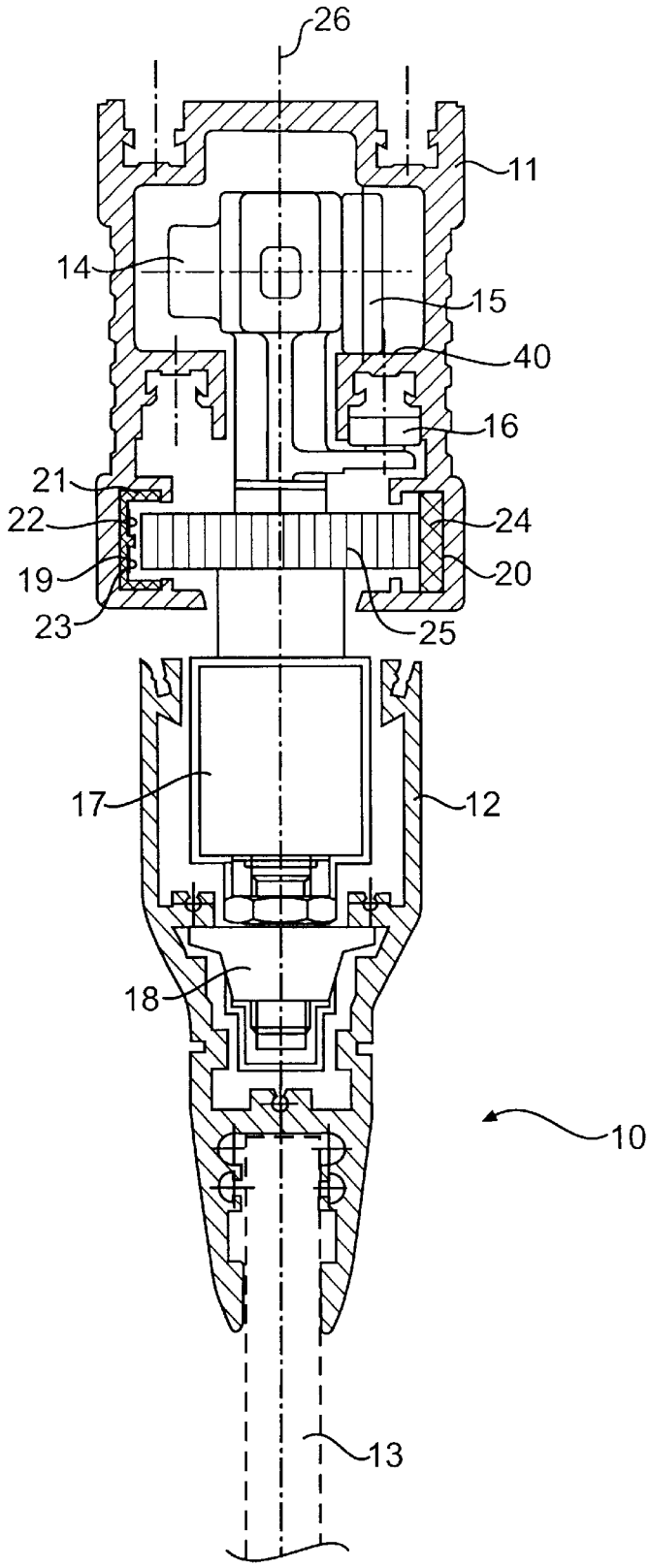
FIG. 1 a cross section of a preferred embodiment of a sliding wall according to the invention, showing the upper part of a wall element with the support profile, the one running gear comprising the drive, and the track.
Figure 2:
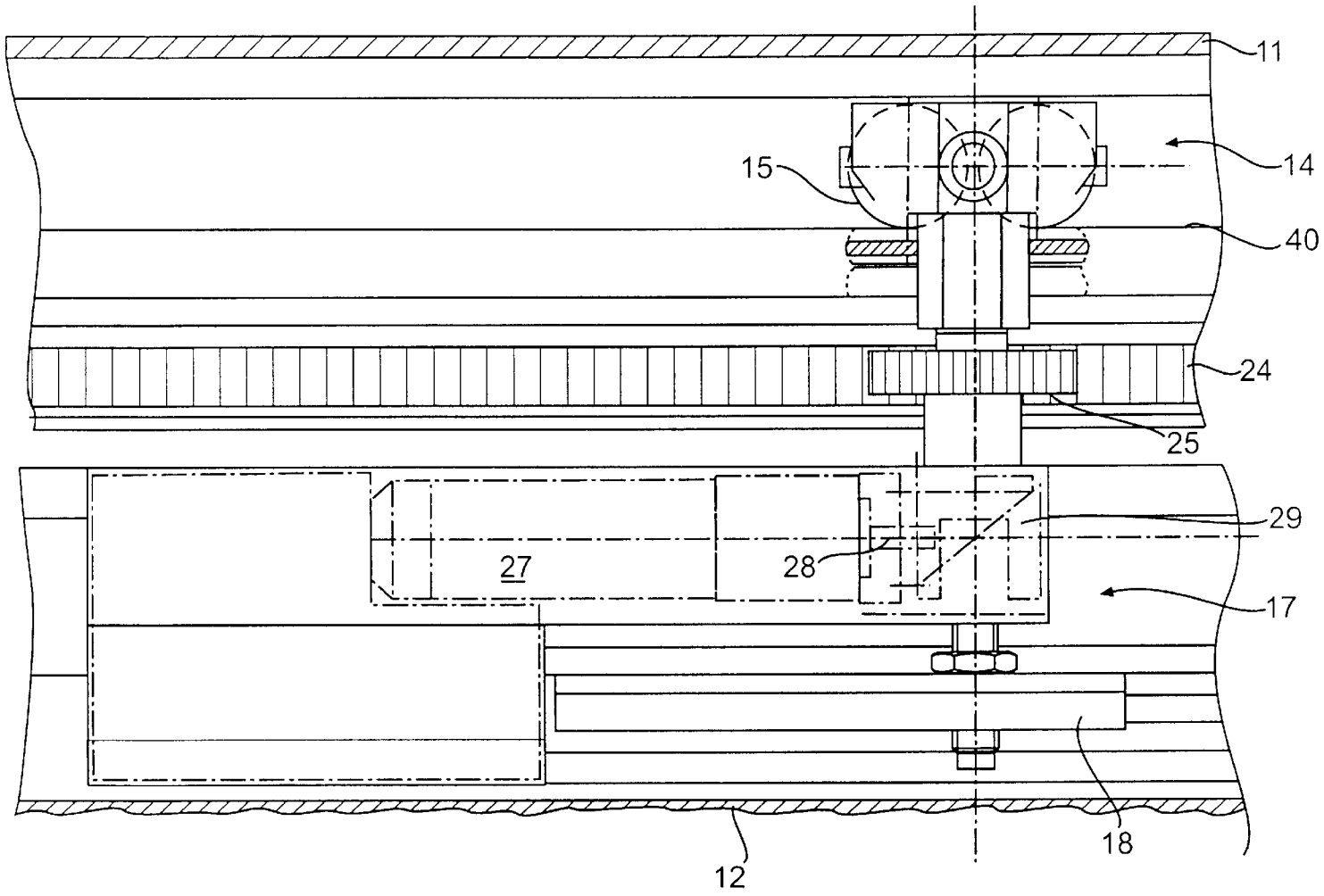
FIG. 2 the elements shown in FIG. 1 in a partially cut away lateral view.

FIG. 1 shows a cross section of a preferred embodiment of a sliding wall according to the invention. The sliding wall 10 comprises a movable wall element 13 e.g. a glass panel or similar. On the margin towards the ceiling, the wall element 13 is delimited by a support profile 12; it is held at the lower part of this support profile 12. A first running gear 14 is attached in the upper part of the support profile 12 by means of a sliding block 18. Said first running gear 14 reaches into the interior of a track 11 (which is constructed as a hollow profile and is attached to the ceiling) where it forms part of a track carriage which is moveable on a running surface 40 in the direction of the rail by means of laterally attached carrying rollers 15, said running surface 40 being located within the track 11. Below the vertically arranged carrying rollers 15, horizontally arranged lateral guide rollers 16 are arranged for lateral guidance of the running gear 14 in the track 11. For motorised drive of the wall element 13, a drive module 17 is provided on the running gear 14 which comprises an electric drive motor 27 positioned horizontally within the support profile 12, as shown in FIG. 2. With its drive axis 28, the drive motor 27 drives a drive pinion 25 rotatable around a vertical axis, by way of an angular gear arrangement 29. The drive pinion 25 is arranged in the lower part of the track 11, below the running surface 40 where it interacts with a toothed belt 24 which in a laterally vertical position has been inserted into a lateral groove 20 of the track 11 where it has been fixed in place. The functional axis of the toothed belt 24 and the axes of the lateral guide rollers 16 are very close together. This ensures that even in curved sections of the track and with fixed installation of the drive, the drive pinion 25 does not fail to interact with the toothed belt 24.

Figure 3:
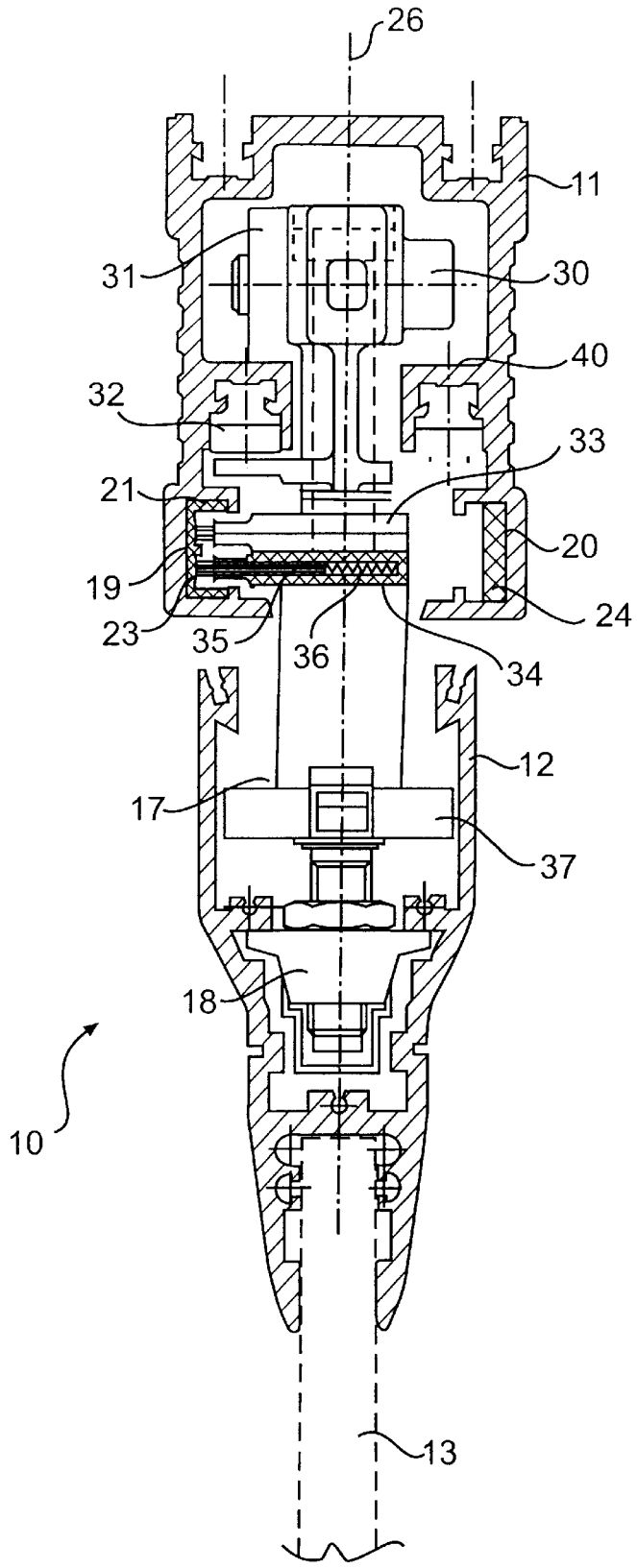
FIG. 3 a cross section of the embodiment from FIG. 1 in the region of the second running gear incorporating current collectors.
Figure 4:
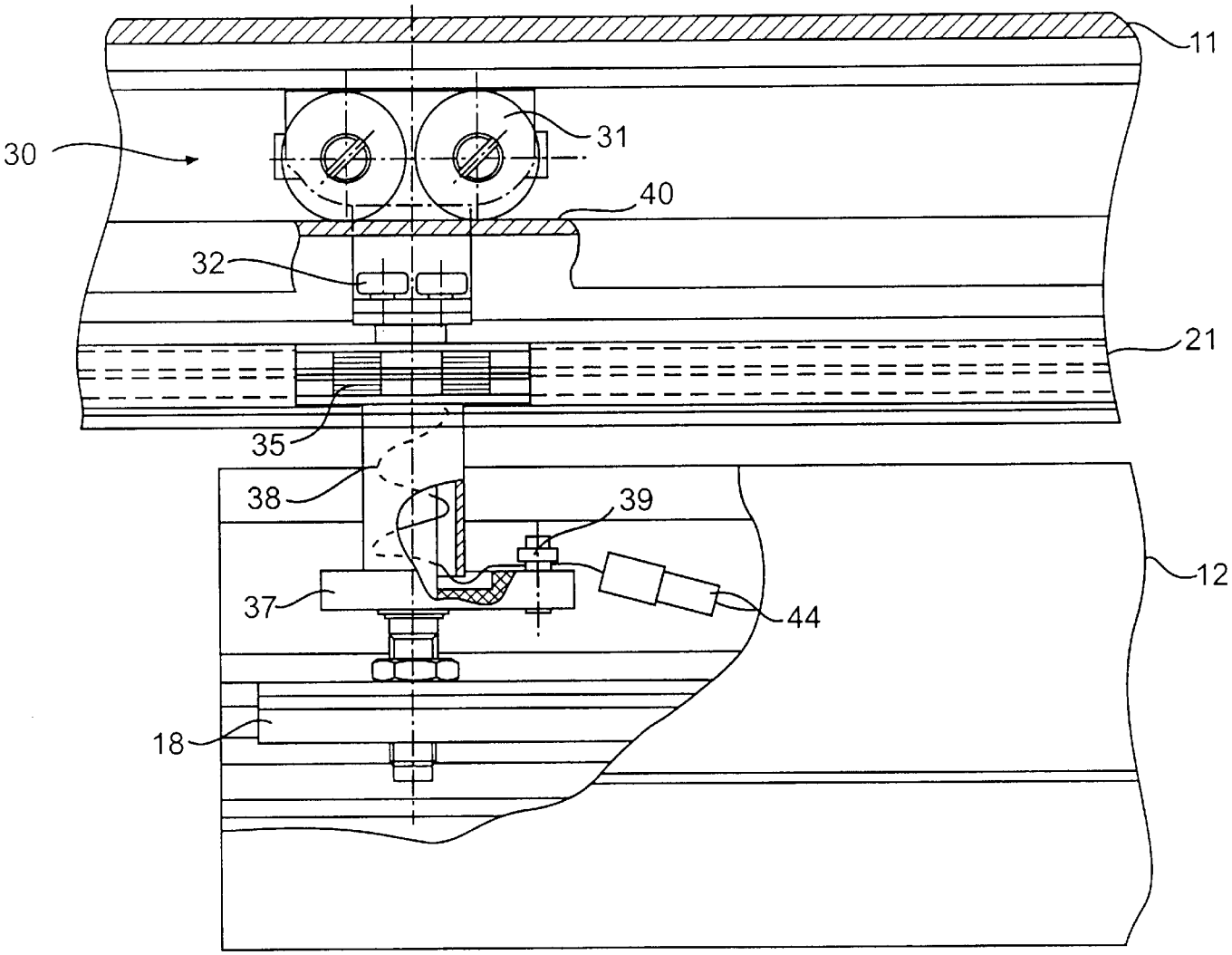
FIG. 4 a partially cut away lateral view of the elements shown in FIG. 3.

On the other side of the centre axis 26, there is a second lateral groove 19, axially symmetrical to the lateral groove 20, accommodating a conductor rail 21 extending in the direction of the track comprising two conductors 22 and 23 arranged vertically one on top of the other. The conductor rail carries the electricity required to drive the drive motor 27. The electricity is collected from the conductor rail 21 by current collectors 33, 34 which are attached to a second running gear 30 as shown in FIGS. 3 and 4. In principle the second running gear 30 is constructed in the same way as the first running gear 14 and attached to the associated groove in the support profile 12 by means of a sliding block 18'. The second running gear reaches into the interior of the track 11 in the same way as the first one, where it forms part of a track carriage which by means of laterally attached carrying rollers is moveable on a running surface 40 and which for lateral guidance comprises horizontally positioned lateral guide rollers 32 arranged below the vertically positioned carrying rollers 31. The carrying rollers 31 of the second running gear 30 are placed axial-symmetrically in respect of the carrying rollers 15 of the first running gear 14. The same applies to the lateral guide rollers 16 and 32. Accordingly, the rail 11 is constructed axial-symmetrically in respect of the centre plane 26.

The different arrangement of the carrying rollers 15 or 31 and the lateral guide rollers 16 or 32 in the track 11 make it possible to divide the track 11 in the parking region of the wall elements, from the centre plane into two separate rail sections, and to let the rail sections diverge. In this way, in the parking region, one running gear of the wall elements moves into one rail section and the other into the other rail section. In this way they can individually placed at an angle and a plural number of them can be lined up in a space-saving vertical stack. Due to the arrangement of the rollers 15, 16, the running gear 14 with the drive module 17 and the drive pinion 25 remain in that track section which also contains the toothed belt 24. Correspondingly, the running gear 30 with the current collectors 33, 34 remains in that rail section in which the conductor rail 21 is continued.

Arranging the conductor rail 21 and the toothed belt 24 in the opposite grooves 19, 20 of the rail profile not only saves place, thus making it possible to keep the track arrangement very compact, but it also ensures that the same track 11 can be used in the same way and without any restrictions both for manually slidable and for automatically slidable wall elements 13. In the first stage which incorporates manual operation, the lateral grooves 19, 20 of the track can be left empty. Correspondingly, wall elements are used which comprise the same running gear 14, 30, but without drive module 17 and without current collectors 33, 34. If subsequently there is a change to automatic operation, it is simply necessary to insert a conductor rail 21 and a toothed belt 24 into the lateral grooves 19, 20 of the track 11, and to exchange the existing running gear of the wall elements with running gear incorporating electric motor drive and current collectors. No further changes are necessary. Of course, the track 11 can be equipped with a conductor rail and/or toothed belt from the start. In this case, the transition from manual operation to automatic operation only requires exchange of the running gear.

As shown in FIG. 3, the current collectors 33, 34 comprise individual contact elements 35 which are retained in the current collectors 33, 34 so as to be slidable perpendicular to the conductor rail 21 and so as to be pushed by a spring 36 against the conductors 22, 23 retained in an insulated way within the conductor rail 21, thus forming sliding contacts. According to FIGS. 3 and 4, the current taken by the current collectors 33, 34 is lead by electrical leads 38 to connection posts 39 attached to a connection plate 37 from where it is led to the drive motor 27, for example by way of a plug contact 44 which can be unplugged for installation or maintenance purposes.

Figure 5:
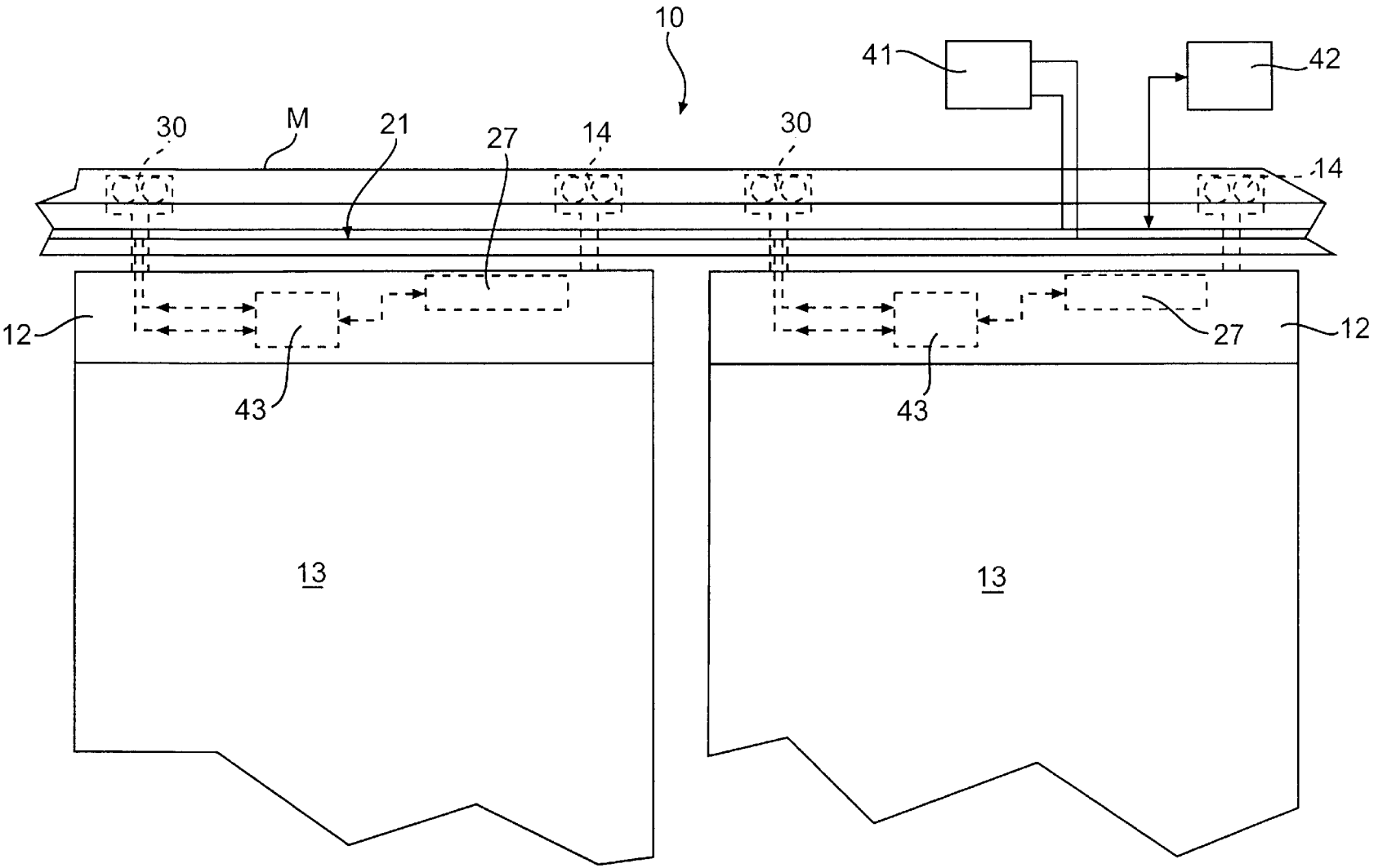
FIG. 5 a diagrammatic representation of a preferred embodiment of a control unit for the sliding wall according to FIG. 1.

FIG. 5 shows that for controlled movement of the individual wall elements 13 in the track 11 from an allocated position in the closed wall to a parking position and vice versa, a (programmable) central control unit 42 with respective computer and software capacity is provided. Said central control unit 42 exchanges data via a data bus with local microprocessor-equipped control units 43 located in the individual wall element 13, which control and monitor the movement and the actual state (position, speed of movement, acceleration, braking, drive torque, etc.) of the respective wall element. Data transmission between the central control unit 42 and the local control units can be in various ways, e.g. by radio control. It is particularly simple and appropriate if the conductor rail 21 itself is used as the data bus which in this case conveys the current from a current supply point 41 for the drive modules 17 of the wall elements 13 as well as the data exchanged between the control units 42 and 43. In this case, selection of a particular wall element is by way of an address code which unambiguously characterises the respective wall element.

The local control units 43 are arranged between the current collectors in the running gear 30 and the drive motors 27. For example the drive motor 27 can comprise a rotation angle transmitter which by integrating the rotational angle, makes it possible to determine the distance travelled by the wall element. At the same time, current and voltage at the drive motor 27 can be measured and conclusions can be drawn concerning the load, e.g. as a result of a suddenly appearing obstacle in the path of the wall element. These conclusions can be used to initiate an emergency stop. Furthermore it is imaginable to detect the approach of a wall element towards another wall element by means of a proximity sensor and to carry out an optimal approach by way of the local control unit 43, for example with reduced speed during the last centimeters. It is advantageous that the track 11 need not be modified for this type of distributed control system, but can simply keep its design with continuous conductor rail and continuous toothed belt.

Overall the invention provides a sliding wall featuring the following characteristics and advantages:

- The conductor rail and the toothed belt are integrated in the track, saving space and protecting these components;
- Identical accommodation chambers (lateral grooves) exist for accommodating the conductor rail and the toothed belt (axially symmetrical track profile);
- The toothed belt has been installed vertically and the drive pinion is arranged horizontally in a corresponding way, thus greatly simplifying installation in a curved section;
- The track axis of the lateral guide roller and the functional axis of the toothed belt in the driven running gear are as close together as possible; consequently even in curved sections the drive can remain installed in a fixed way—no axial movement takes place;
- Very simple changeover from manual operation to automatic operation—it is easy to retrofit the running gear with a drive unit and a current collector unit;
- No visible difference between manual and automatic setup:

The fittings and drive components are of modular design;

Each wall element is an autonomous entity incorporating a local control unit.

List of References

10 Sliding wall
11 Track
12 Support profile
13 Wall element
14, 30 Running gear
15, 31 Carrying roller
16, 32 Lateral guide roller
17 Drive module
18, 18' Sliding block
19, 20 Lateral groove
21 Conductor rail
22, 23 Conductor
24 Toothed belt
25 Drive wheel (pinion)
26 Central plane
27 Drive motor
28 Drive axis
29 Angular gear arrangement
33, 34 Current collector
35 Contact element
36 Spring
37 Connection plate
38 Electrical lead
39 Connection post
40 Running surface
41 Electricity supply
42 Central control unit
43 Local control unit
44 Plug contact

What is claimed is:

1. A sliding wall comprising:

a plurality of individually slidable wall elements, each of the wall elements being delimited at an upper edge by a horizontally aligned support profile and each of the wall elements being laterally slidable along a common track arranged above the support profile by at least one running gear attached to the support profile;

a drive including an electrically operated drive motor being attached to each of the wall elements and interacting with the track by way of a drive mechanism, wherein the drive motor is arranged within the support profile of each wall element.

2. The sliding wall of claim 1, wherein a drive axis of the drive motor is aligned parallel to a longitudinal axis of the support profile.

3. The sliding wall of claim 2, wherein the drive mechanism comprises a pinion driven by the drive motor which interacts with a toothed profile extending longitudinally within the support profile.

4. The sliding wall of claim 3, wherein the toothed profile includes a toothed belt inserted into the support profile and the pinion is rotatable around a vertical axis and interacts with the the toothed belt, and further wherein power transmission from the drive motor to the pinion is by way of an angular gear arrangement.

5. The sliding wall of claim 4, further comprising a conductor rail extending in a longitudinal direction to the track and arranged within the track, wherein each wall element comprises a running gear with current collectors attached to the running gear to collect current from the conductor rail and conduct the current to the drive motor.

6. The sliding wall of claim 5, wherein each wall element comprises two running gears arranged one behind the other in a direction of travel of the wall, each of the wall elements being driven via the first running gear and the current collection occurring via the second running gear.

7. The sliding wall of one of claims 5 or 6, wherein the track is configured as a profile rail axially symmetrical to a center axis, an interior of the track comprising a running surface on which the running gears run on carrying rollers, and further wherein two lateral grooves facing each other and aligned in a longitudinal direction of the rail are disposed below the running surface, said lateral grooves being open toward an inside and the conductor rail being arranged in one of the lateral grooves and the toothed belt being arranged in the other of the lateral grooves.

8. The sliding wall of any one of claims 1 to 5, further comprising a local control unit provided in each of the wall elements, said local control unit for controlling the drive motor of the associated wall element and each of the local control units being configured to exchange information via a data bus with a central control unit.

9. The sliding wall of claim 8, wherein a conductor rail extending in a longitudinal direction to the track and arranged within said track is used as the data bus.

10. The sliding wall of claim 8, further comprising a control mechanism configured to gather information concerning the movement of each wall element and to transmit the gathered information for further processing.

11. A sliding wall assembly comprising:

at least one slidable wall element configured to form at least part of a wall;

a support member disposed along an edge of the wall element, said support member being configured to slidably couple the wall element to a track and to support the wall element from the track; and an automatic drive element disposed within the support member, said drive element configured to automatically slide said wall element along the track.

12. The sliding wall assembly of claim 11, further comprising:

at least one roller operably coupled to the automatic drive element and configured to engage the track to slide the wall element along the track.

13. The sliding wall assembly of claim 11, wherein the automatic drive element includes an electrically-operated drive motor.

14. The sliding wall assembly of claim 13, further comprising the track and a conduction mechanism disposed within a portion of the track to collect current and conduct the current to the drive motor.

15. The sliding wall assembly of claim 13, wherein the drive motor has a longitudinal axis parallel to the longitudinal axis of the support member.

16. The sliding wall assembly of claim 11, further comprising a local control unit associated with the slidable wall element, said local control unit being configured to control the automatic drive element and to exchange information with a central control unit.

17. The sliding wall assembly of claim 16, wherein the information exchanged includes movement and position of the wall element.

18. A sliding wall system, comprising:

a plurality of individually slidable wall elements slidable along a track;

a drive mechanism operably coupled to each wall element to slide each wall element along the track;

a local control unit operably coupled to each wall element for controlling the drive mechanism associated with each wall element; and a central control unit for exchanging data with the local control units and for controlling movement of the plurality of wall elements.

19. The sliding wall system of claim 18, further comprising a data bus for exchanging the data between the central control unit and the local control units.

20. The sliding wall system of claim 21, wherein the data bus includes a conductor rail extending in a longitudinal direction with respect to the track and arranged within the track.

21. The sliding wall system of claim 18, wherein the data is exchanged between the central control unit and the local control units via wireless transmission.

22. The sliding wall system of claim 21, wherein the data is exchanged between the central control unit and the local control units via radio.

23. The sliding wall system of claim 18, wherein each wall element includes at least one sensing mechanism configured to sense information about at least one of the movement and position of each wall element.

24. The sliding wall system of claim 23, wherein the sensing mechanism transmits the sensed information to the local control unit of each wall element.

25. The sliding wall system of claim 24, wherein movement and positioning of the wall elements are controlled depending on the sensed information.

26. The sliding wall system of claim 18, wherein the data exchanged between the central control unit and the local control units includes at least one of position, speed, acceleration, braking, and drive torque of the wall elements.

* * * * *